US005542822A

United States Patent [19]

Stretz et al.

[11] Patent Number: 5,542,822

[45] Date of Patent: Aug. 6, 1996

[54] LIQUID RING PUMP AND SEPARATOR CONTAINER ASSEMBLY

[75] Inventors: Manfred Stretz, Erlangen; Günter Holzheimer, Baiersdorf; Hans-Rene Neubauer, Weisendorf, all of Germany

[73] Assignee: Siemens Aktiengesellschaft, München, Germany

[21] Appl. No.: 442,732

[22] Filed: May 17, 1995

[30] Foreign Application Priority Data

May 19, 1994 [DE] Germany ..... 44 17 607.4

[51] Int. Cl.[6] ..... F04C 19/00; F04B 39/16

[52] U.S. Cl. ..... 417/68; 417/313; 417/372

[58] Field of Search ..... 417/68, 69, 312, 417/313, 372; 210/188, 416.1

[56] References Cited

U.S. PATENT DOCUMENTS

| | | | |
|---|---|---|---|
| 1,714,735 | 5/1929 | Skidmore, Jr. | 417/69 |
| 4,057,368 | 11/1977 | Balling | 417/313 |
| 4,083,659 | 4/1978 | Schmidt | 417/68 |
| 4,657,487 | 4/1987 | Schönwald et al. | 417/68 |

FOREIGN PATENT DOCUMENTS

| | | | |
|---|---|---|---|
| 0969928 | 7/1958 | Germany . | |
| 2460268 | 7/1976 | Germany . | |
| 291487 | 12/1987 | Japan | 417/68 |
| 186985 | 8/1988 | Japan | 417/68 |
| 1707249 | 1/1992 | U.S.S.R. | 417/68 |
| 1379378 | 1/1975 | United Kingdom | 417/68 |

OTHER PUBLICATIONS

SIEMENS PROSPECTUS "*Funktion des ELMO—Aggregates*" (1974).

*Primary Examiner*—Louis J. Casaregola
*Assistant Examiner*—Roland G. McAndrews, Jr.
*Attorney, Agent, or Firm*—Kenyon & Kenyon

[57] ABSTRACT

An upright L- or U-shaped separating container with a pump unit mounted on the horizontal part thereof. The separating container is provided with an inlet opening towards its bottom and an outlet opening towards its top. The pump unit is comprised of a cooled drive motor connected to a liquid ring pump. The liquid ring pump is comprised of a center shaft, an intake stub, and an output stub. The output stub of the liquid ring pump is connected to the inlet opening of the separating container. At least part of the separating container extends below the center shaft of the liquid ring pump of the pump unit.

14 Claims, 5 Drawing Sheets

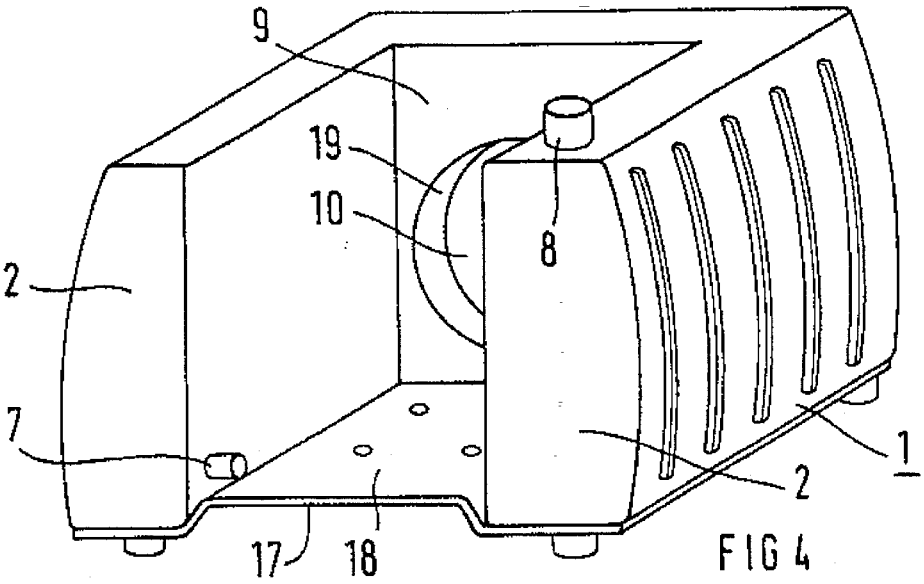
FIG 4
FIG 5
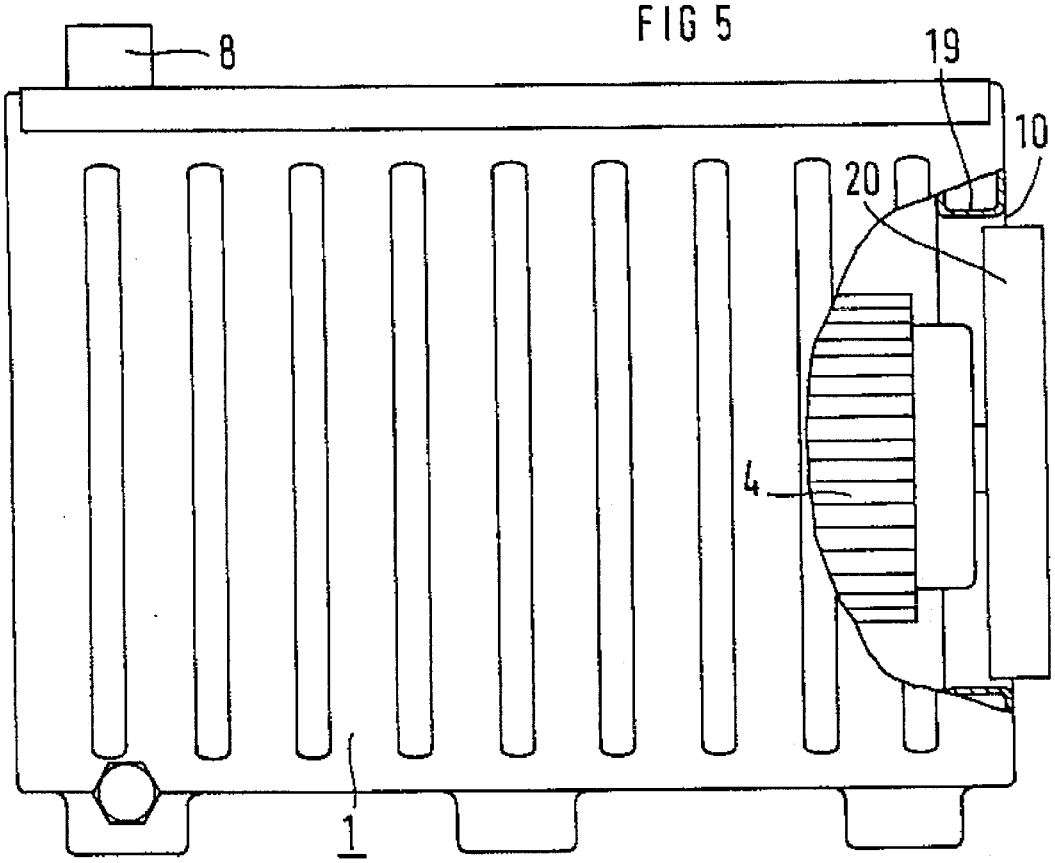

LIQUID RING PUMP AND SEPARATOR CONTAINER ASSEMBLY

BACKGROUND OF THE INVENTION

The present invention relates to a pump assembly with an L- or U-shaped separating container with a pump unit mounted thereupon.

A pump assembly of this kind is disclosed in German Patent Application No. 24 60 268. In this assembly, the separating container is in the shape of a U lying down, on which the pump unit is mounted. The gas-liquid mixture expelled by the liquid ring pump is conducted at the free end of one leg of the U into the separating container through an inlet opening provided in said leg, and the gas escapes from the separating container at the free end of the other leg of the U through a corresponding outlet opening. In this separating container, there is a continuous path between the inlet opening and the outlet opening, above the gas chamber of the separating container, through which path the atmospheric noise generated by the pump can propagate undamped.

As a result of the separating container being located beneath the liquid ring pump, the latter drains completely when stopped, so that restarting is possible only with appropriate auxiliary measures.

SUMMARY OF THE INVENTION

The present invention is directed to the problem of developing a pump assembly that provides noise damping and the capability of starting the liquid ring pump without additional measures.

The present invention solves this problem by providing an upright L- or U-shaped separating container with a pump unit mounted thereon. The separating container is conveniently provided with an inlet opening towards its bottom and an outlet opening towards its top. The pump unit is comprised of a drive motor connected to a liquid ring pump. The drive motor is provided with a cooling means, preferably a fanwheel. The liquid ring pump is comprised of a center shaft, an intake stub, and an output stub. The output stub of the liquid ring pump is connected to the inlet opening of the separating container. The pump unit is mounted on the horizontal part of the separating container so that at least part of the separating container extends below the center shaft of the liquid ring pump.

Designing the separating container in the shape of a standing L or U ensures that the horizontal part of the separating container is completely filled with working liquid. As a result of the introduction of the gas conveyed by the liquid ring pump into the horizontal part of the separating container, this gas passes through the liquid contained in the separating container at least partially in a horizontal or approximately horizontal direction. This slows the rate at which the gas moves through the horizontal part of the separating container, thereby reducing the noise generated by the operation of the pump assembly. The noise is further reduced by the long path traveled by the gas through the liquid until it enters the gas chamber of the separating container, as well as the multiple deflections of the gas along its route. In particular, the noise occurring at the frequency of the blades is significantly reduced over that of the prior art. Operating noise is further reduced by partially filling the separating container with liquid. Consequently, no connecting elements are required to break the conduction of structure-borne noise to the base or between the pipe sections to be connected to the inlet and outlet openings of the liquid ring pump.

In addition, due to the height of said container in the vertical direction because of the L or U shape of the separating container, the level of the liquid in the separating container can be chosen such that the liquid ring pump remains partially filled with liquid while the assembly is shut down. Because of this partial filling, the liquid ring pump can be started without any special additional measures.

In addition, the vertical leg or legs of the separating container provide mechanical protection for the pump unit mounted on the horizontal part of the separating container.

Advantageously, the outlet opening is provided on the top of the vertical leg or of one of the vertical legs of the L- or U-shaped separating container. As a result, an area filled only with gas is always present in the separating container above the level of the liquid.

The mechanical strength of the assembly unit can be increased by closing off the front or rear of a U-shaped design by means of a wall part. In such an embodiment of the pump assembly, the pump unit is surrounded on at least three sides by the separating container, further improving sound insulation.

The wall part is made in the form of a chamber part connecting the two legs of the separating container such that its interior communicates freely with the interior of the rest of the separating chamber.

The wall part may be advantageously provided with an opening therethrough for surrounding the cooling means of the drive motor, simultaneously creating a barrier between the intake and outlet sides of the motor fan. The depth of the wall part can be such that the circumferential inner surface of the opening can form the air duct for the cooling means for the drive motor, e.g., for the fanwheel of a cooling blower.

Both mechanical protection for the pump unit and sound insulation of the pumping assembly are further improved by the fact that in a U-shaped design for the separating container, a cover part can be mounted on its top, across its two vertical legs.

One or more baffles can be installed in the separating container along the path from the inlet and outlet. The baffles smooth the level of the liquid in the separating container, and further reduce the amount of noise emitted during thee operation of the pump assembly.

It is also advantageous for ribs to be provided on the separating container. Such ribs can simultaneously perform the dual function of cooling and reinforcing the separating container.

The invention will now be described in greater detail with reference to an embodiment shown in the drawing.

BRIEF DESCRIPTION OF THE DRAWINGS

FIG. 4 shows a U-shaped separating container mounted on a base plate;

FIG. 5 shows a separating container in a side view with a partial section on the fan side;

DETAILED DESCRIPTION

Figure 1:
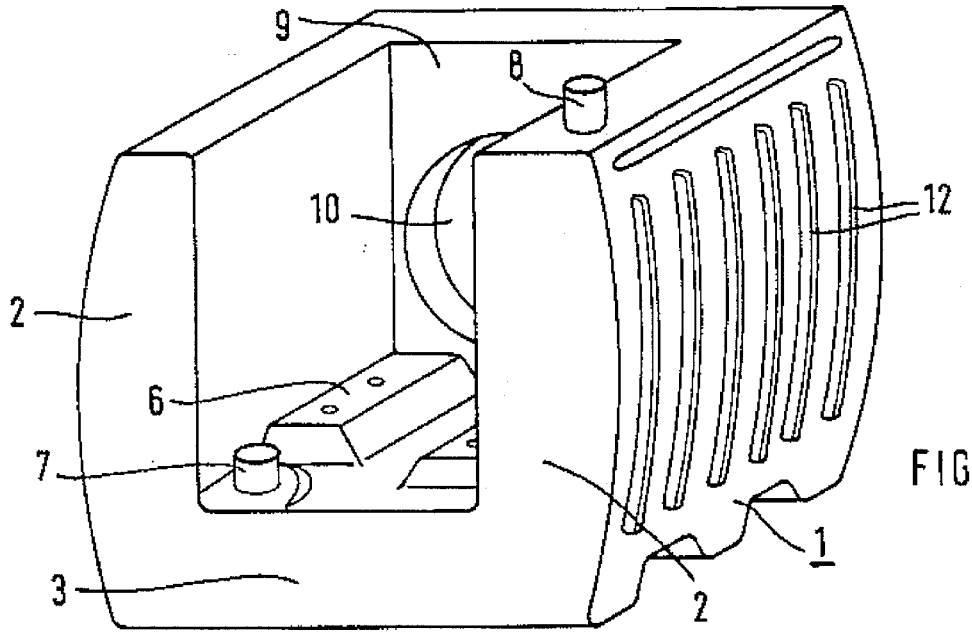
FIG. 1 shows a separating container, U-shaped in cross section, of a pump assembly in a perspective view.
Figure 2:
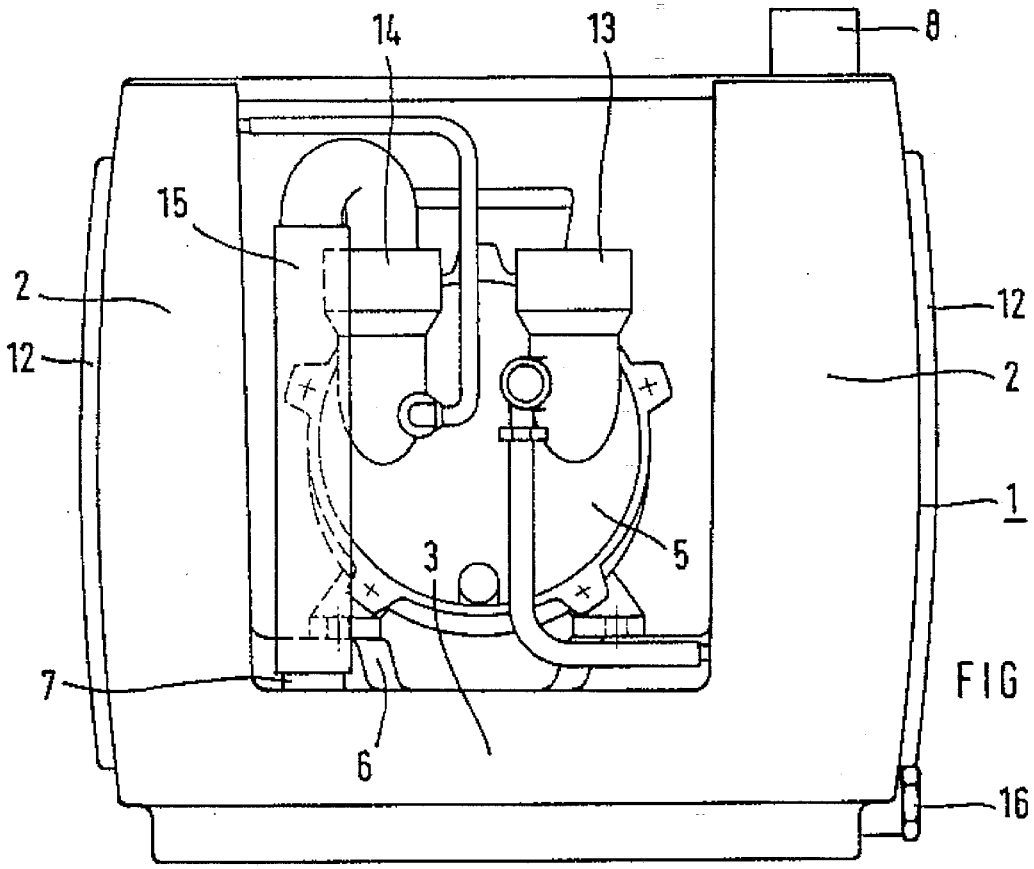
FIG. 2 shows a pump assembly composed of a separating container, U-shaped in cross section, and a pump unit connected therewith, in a front view.

Reference numeral 1 designates a separating container made U-shaped in cross section. U-yoke 3 connecting the two vertical legs 2 of the U serves as a mounting surface for a pump unit composed of a drive motor 4 and a liquid ring pump 5. In addition, matching mounting strips 6 are molded on the inside of U-yoke 3 for mounting drive motor 4. In addition, a first pipe stub 7 forming the inlet of separating container 1 and a second pipe stub 8 forming the outlet of separating container 1 and mounted on the top of one of the legs 2 of the U is mounted on this inside.

A wall part 9 connecting the two legs 2 of the U is provided on the back of separating container 1. This wall part has an opening 10 traversed by fan shroud 11 of drive motor 4, so that drive motor 4 can draw its cooling air from the vicinity of separating container 1. Wall part 9 thus simultaneously separates the intake side of the motor fan from its outlet side. In addition, opening 10 can simultaneously form the air duct for the fanwheel of a fan provided for cooling, so that no separate fan shroud is required for this fan.

Figure 3:
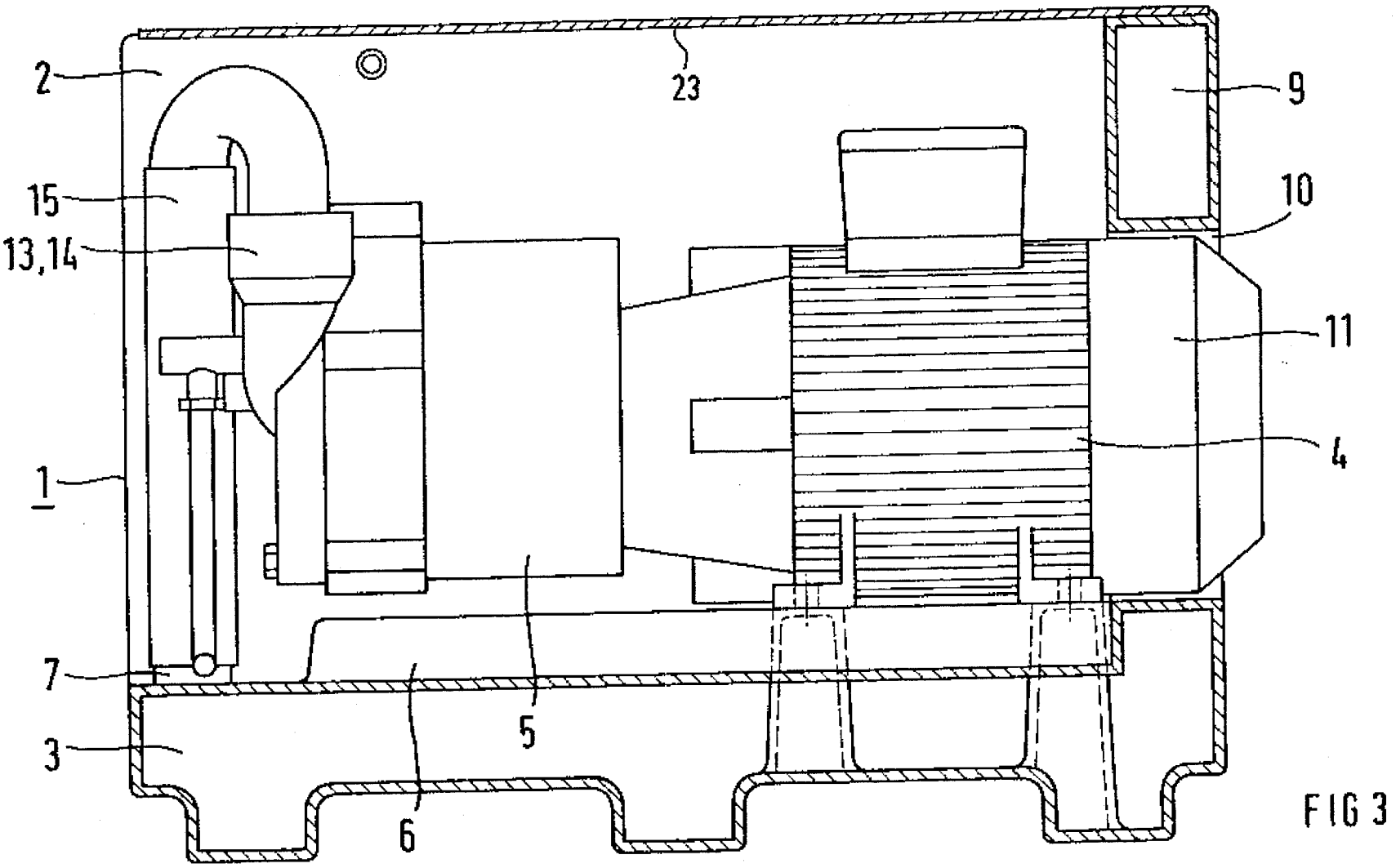
FIG. 3 shows a separating container, U-shaped in cross section, in a lengthwise section, with a motor/pump unit on its horizontal part, between the two vertical parts.
Figure 6:
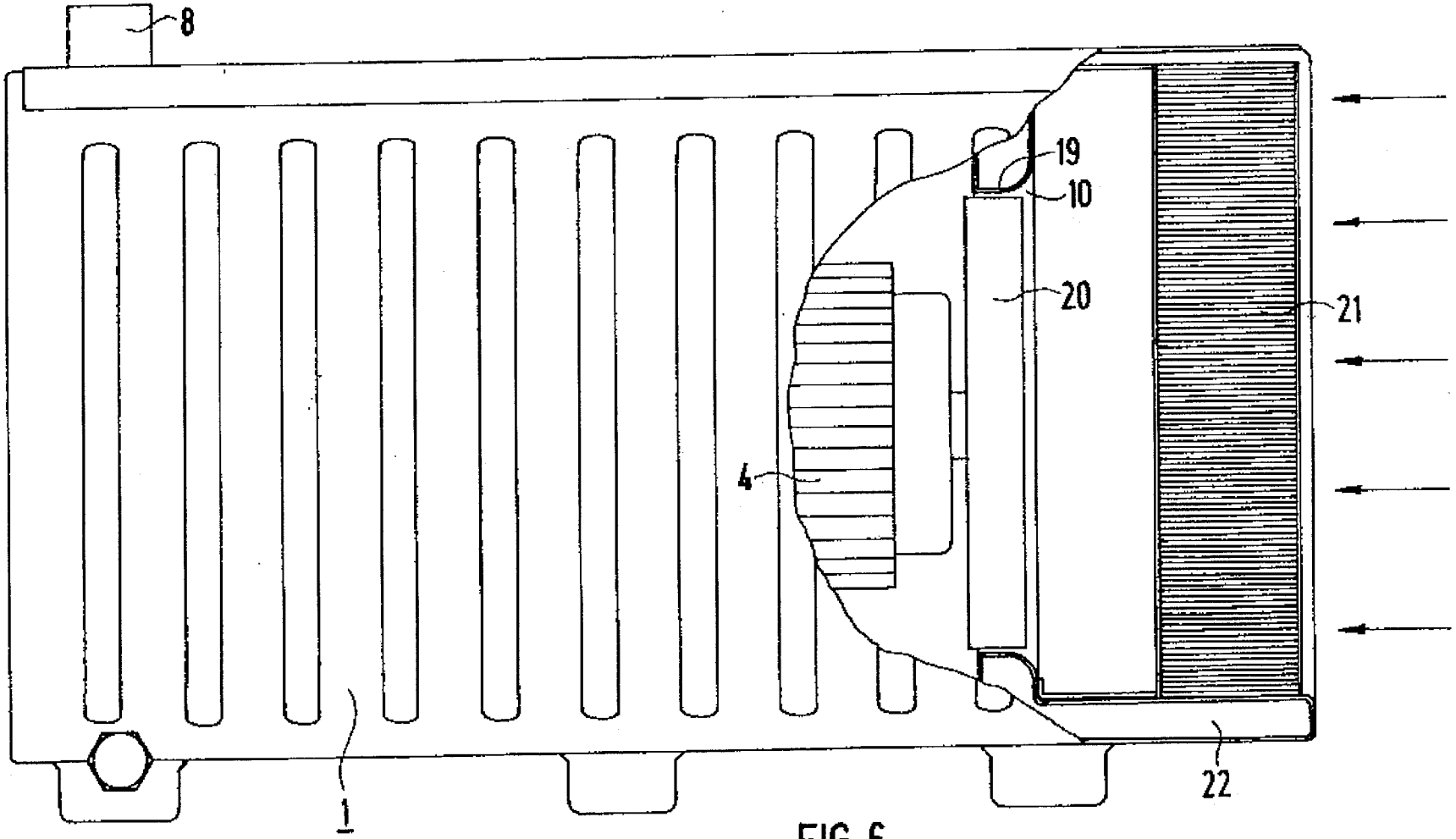
FIG. 6 shows a separating container which is axially elongated beyond the drive motor.

As is evident from the drawing in FIG. 3, wall part 9 is made in the form of a hollow chamber part, so that a flow connection is provided through this wall part 9 between the two vertical legs 2 of the U.

Ribs 12 for cooling and reinforcement are molded on the exterior of vertical legs 2 of the U. Liquid ring pump 5 is provided in usual fashion with an intake stub 13 and an outlet stub 14. Outlet stub 14 of liquid ring pump 5 is connected by appropriate pipe parts 15 with first pipe stub 7 of separating container 1. A drain stub 16 is mounted on separating container 1 to drain the container.

Liquid ring pump 5 draws in the gas to be compressed through its intake stub 13; after compression in liquid ring pump 5, this gas is expelled together with the working liquid through outlet stub 14 and is conducted through pipe parts 15 and first pipe stub 7 into separating container 1 below the liquid level. The gas thus flows through horizontal U-yoke 3 of separating container 1 and then rises in vertical legs 2 of the U into the space that is above the liquid level of the liquid contained in separating container 1, which space is still filled with gas only. As the gas flows through horizontal U-yoke 3, the flowrate of the gas is reduced sharply so that separation of liquid particles entrained in the gas bubbles in the form of drops is considerably improved. In this manner, and with subsequent passage of the gas through the space located above the liquid level, nearly 100% of the liquid particles entrained in drop form are separated.

As a result of the considerable slowing of the flowing gas and the long path it takes through the liquid and through the gas space, the noise at blade frequency is suppressed to a considerable degree. If additional wall parts or constrictions (such as baffles) are provided as barriers in separating container 1, the flowrate and the length of the flow path within the liquid and the gas space can be influenced accordingly as a result, and separation and noise suppression can be improved even further.

The U-shaped space of separating container 1, already largely enclosed by vertical legs 2 of the U and wall part 9, may be advantageously provided with a cover part 23 placed on the top of legs 2 of the U. This further suppresses the noise emitted by drive motor 4. In addition, the cooling air blown by the motor fan is guided well over the motor surface.

The pump unit composed of drive motor 4 and liquid ring pump 5 is mounted on separating container 1 by the manufacturer. Consequently the pump assembly can be supplied as a complete unit and need only be set up at the desired location and connected to a power supply and to the flow. No other mounting efforts are required. Incorporating the pump unit in the U-shaped space of separating container 1 also provides considerable mechanical protection for the pump unit. The arrangement of all or at least part of separating container 1 below the pump unit also permits this container to function as a liquid supply tank. With closed-circuit operation of the liquid ring pump, the liquid contained in separating container 1 can constitute the necessary liquid supply. It is then merely necessary to make up the liquid losses caused by saturation of the expelled gas.

In the pump assembly described, liquid ring pump 5 drains down to the level of the liquid in separating container 1 when it is stopped. Thus, liquid ring pump 5 of the present invention is thus no longer completely filled with liquid when stopped, unlike the pump assembly according to the prior art, which situates the separating container above the liquid ring pump. The reduced filling of the liquid ring pump 5 of the present invention considerably facilitates its starting when the pump assembly is restarted, since little or no liquid need be delivered by the pump to make it functional. Therefore the load on the pump is considerably reduced when starting.

FIG. 4 shows another embodiment of a separating container. In this version, separating container 1 is made in the shape of a U or a horseshoe and mounted on a base plate 17. Area 18 of base plate 17 located between the two legs of the U is used to mount the pump unit composed of the drive motor and the liquid ring pump. First pipe stub 7 that forms the intake of separating container 1 is provided in the lower part of one leg 2 of the U. Second pipe stub 8 that forms the outlet is located on the top of the other leg of the U. Since the flow connection of the two legs of the U is provided solely by wall part 9 that forms the yoke of U-shaped separating container 1, there is a very long flow path between the two pipe stubs 7 and 8. This is favorable, especially for noise suppression.

By an appropriate adjustment of the liquid level in separating container 1, liquid ring pump 5 can be only partially filled with liquid when stopped, so that restarting is facilitated here as well.

Since both separating container 1 and pump unit 4/5 can be mounted on base plate 17 by the manufacturer, an operationally ready unit is available that can be set up at the location of the operator of the pump assembly without further measures being required.

As can be seen from FIG. 5, there is a provision for using wall 19 of opening 10 as an air duct for the fanwheel of the cooling blower of the motor. The chamber part connecting the two legs 2 of the U, resulting from the design of wall part 9, provides a corresponding depth of this wall part 9 so that opening 10 can act as a duct, especially if fanwheel 20 is an axial fanwheel. A separate fan shroud is therefore no longer required for fanwheel 20.

Pump assemblies often work in connection with an additional radiator 21. Such a radiator 21 can be combined with the pump assembly to form an operational unit due to the fact that the horizontal leg 3*a* and the horizontal U-yoke 3, respectively, is axially elongated beyond the drive motor 4 and the fan wheel 20 arranged on the respective face thereof, the radiator 21 being arranged on that elongated part 22. The fan wheel 20 of the drive motor 4 can also serve to supply cooling air required for the radiator 21.

The vertical leg or legs 2 of the L-shaped or U-shaped separating container 1 are preferably axially elongated corresponding to the horizontal part 3 or 3*a*. The radiator 21 can be inserted between legs 2 and is thus mechanically protected. In the case of a U-shaped embodiment of the separating container 1, guidance of the cooling air of radiator 21 is effected by legs 2. When the separating container 1 is covered by means of a cover part 23 bearing against the vertical legs 2, a totally enclosed duct is provided for the cooling air traversing radiator 21.

Figure 7:
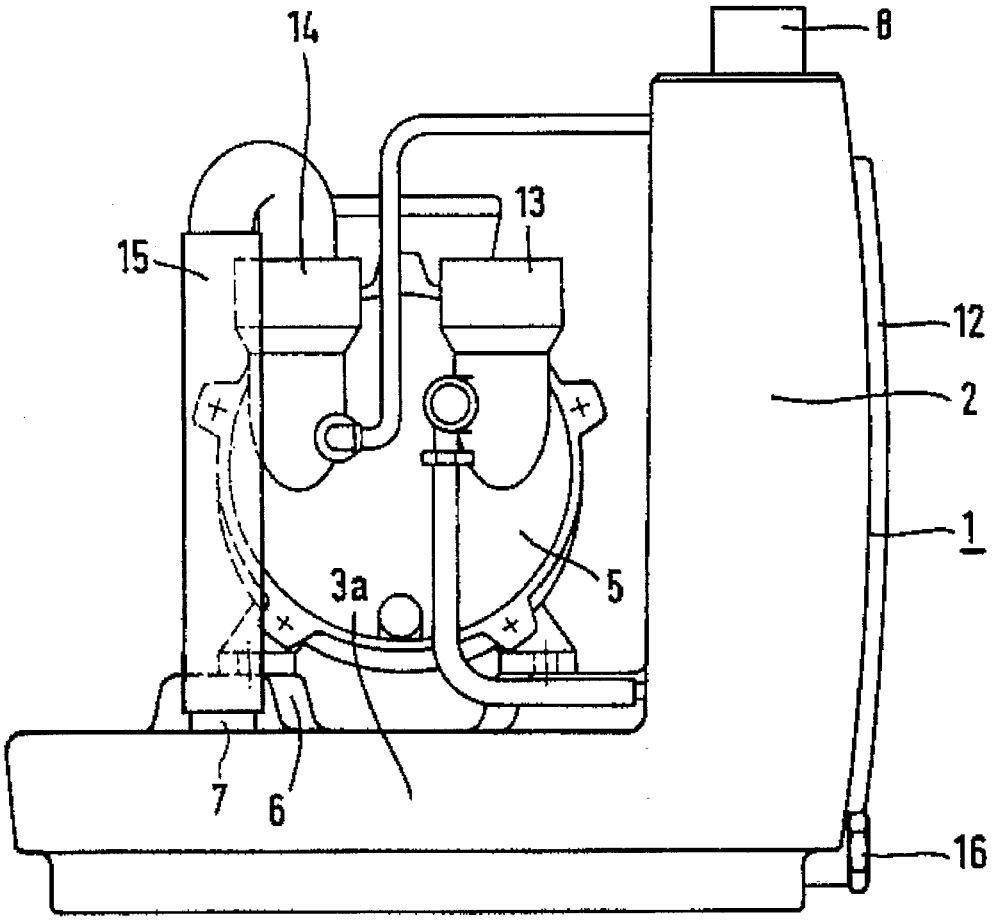
FIG. 7 shows a pump assembly composed of a separating container, L-shaped in cross-section, and a pump unit connected therewith, in a front view.

In the L-shaped embodiment showing in FIG. 7, the vertical leg 2 corresponds in function to the two legs 2 of the U-shaped separating container 1 and the horizontal leg 3*a* corresponds to the horizontal U-yoke 3 of the U-shaped separating container 1.

What is claimed is:

1. A pump assembly, comprising:

(a) a separating container made in the shape of an upright U with a horizontal part, a first vertical part, a second vertical part, an outlet opening, and an inlet opening, said inlet opening mounted on said horizontal part;

(b) a drive motor with cooling means;

(c) a liquid ring pump with a center shaft, an intake stub, and an output stub, said outlet stub connected to said inlet opening;

(d) a pump unit comprising said drive motor coupled to said liquid ring pump, said pump unit mounted on said horizontal part of said separating container with said center shaft above at least part of said separating container.

2. The pump assembly of claim 1, further comprising a wall part with an opening therethrough made in the form of a hollow chamber part providing a flow connection through said wall part between said first vertical part and said second vertical part, wherein said separating container has a first end and a second end, said wall part being formed at said first end of said separating container, and wherein said drive motor has a fan and fan shroud, said fan shroud being enclosed by the opening of said wall part.

3. The pump assembly of claim 1, further comprising a cover part mounted on the top of said separating container.

4. The pump assembly of claim 1, further comprising ribs for reinforcement and cooling molded on the exterior of said separating container.

5. The pump assembly of claim 1, further comprising a wall part with an opening therethrough made in the form of a hollow chamber part providing a flow connection through said wall part between said first vertical part and said second vertical part, wherein said separating container has a first end and a second end, said wall part being formed at said first end of said separating container, and wherein said drive motor has a cooling blower with a fanwheel, the circumferential interior wall of said opening forming an air duct for said fanwheel.

6. The pump assembly of claim 5, further comprising a cover part mounted on the top of said separating container.

7. The pump assembly of claim 1, further comprising a wall part made in the form of a hollow chamber part providing a flow connection through said wall part between said first vertical part and said second vertical part, wherein said separating container has a first end and a second end, said wall part being formed at said first end of said separating container.

8. The pump assembly of claim 7, further comprising a cover part mounted on the top of said separating container.

9. The pump assembly of claim 7, further comprising ribs for reinforcement and cooling molded on the exterior of said separating container.

10. A pump assembly, comprising:

(a) a separating container made in the shape of an upright L with a horizontal part, a first vertical part, said horizontal part joined together in one piece with said first vertical part, an outlet opening, and an inlet opening, said inlet opening mounted on said horizontal part;

(b) a drive motor with cooling means; a liquid ring pump with a center shaft, an intake stub, and an output stub, said output stub connected to said inlet opening;

(d) a pump unit comprising said drive motor coupled to said liquid ring pump, said pump unit mounted on said horizontal part of said separating container with said center shaft above at least part of said separating container.

11. The pump assembly of claim 10, further comprising a wall part made in the form of a hollow chamber part providing a flow connection between said wall part and said first vertical part, wherein said separating container has a first end and a second end, said wall part being formed at said first end of said separating container.

12. The pump assembly of claim 11, further comprising ribs for reinforcement and cooling molded on the exterior of said separating container.

13. The pump assembly of claim 10, further comprising a wall part with an opening therethrough made in the form of a hollow chamber part providing a flow connection between said wall part and said first vertical part, wherein said separating container has a first end and a second end, said wall part being formed at said first end of said separating container, and wherein said drive motor has a fan and fan shroud, said fan shroud being enclosed by the opening of said wall part.

14. The pump assembly of claim 13, further comprising a wall part with an opening therethrough made in the form of a hollow chamber part providing a flow connection between said wall part and said first vertical part, wherein said separating container has a first end and a second end, said wall part being formed at said first end of said separating container, and wherein said drive motor has a cooling blower with a fanwheel, the circumferential interior wall of said opening forming an air duct for said fanwheel.

* * * * *